United States Patent [19]

Cooper et al.

[11] Patent Number: 4,732,629

[45] Date of Patent: Mar. 22, 1988

[54] METHOD FOR MANUFACTURING AN INSULATED CONDUCTOR HAVING A HIGH CUT-THROUGH RESISTANCE

[76] Inventors: Peter B. Cooper, 555 Paper Mill Rd., Newark, Del. 19714; Sarah J. Lane, 3 Phelps La., Newark, Del. 19711

[21] Appl. No.: 889,230

[22] Filed: Jul. 25, 1986

[51] Int. Cl.[4] ..... H01B 13/08

[52] U.S. Cl. ..... 156/53; 156/56; 174/110 FC; 428/377; 428/422

[58] Field of Search ..... 156/52, 53, 55, 56; 174/110 FC; 428/377, 422

[56] References Cited

U.S. PATENT DOCUMENTS

| | | | |
|---|---|---|---|
| 3,422,215 | 1/1969 | Humes | 156/53 X |
| 3,486,961 | 12/1969 | Adams | 174/110 FC |
| 3,488,537 | 1/1970 | Beddows | 174/110 FC |
| 4,756,004 | 9/1973 | Gore | 156/53 X |
| 3,887,761 | 6/1975 | Gore | 156/53 X |
| 3,953,566 | 4/1976 | Gore | 264/288.8 X |
| 4,187,390 | 2/1980 | Gore | 264/288.8 X |
| 4,529,564 | 7/1985 | Harlow | 174/110 FC X |

*Primary Examiner*—Robert A. Dawson

*Attorney, Agent, or Firm*—John S. Campbell

[57] ABSTRACT

This invention provides a method of increasing the cut-through resistance of a PTFE insulated conductor. Unsintered PTFE is expanded and compressed and then applied to a conductor. The insulated conductor is then heated to a temperature above 345° C. The compressed, expanded PTFE has one crystalline melt point above 375° C.

6 Claims, 1 Drawing Figure

METHOD FOR MANUFACTURING AN INSULATED CONDUCTOR HAVING A HIGH CUT-THROUGH RESISTANCE

BACKGROUND OF THE INVENTION

1. Field of the Invention.

This invention relates to high strength, high cut-through resistant, polytetrafluoroethylene (hereinafter PTFE) insulation. This material can be used in electronics and other high technology fields.

2. Description of the Prior Art.

PTFE has become a very important insulation for the wire and cable industry. The use of this material has resulted in a new generation of insulated conductors with improved chemical, thermal, and electrical properties. Depending on the specific application, certain properties of the insulated wire are more desirable than others.

For example, PTFE which has been extruded and subsequently sintered by heating to a temperature above 345° C. has highly desired electrical properties and finds numerous uses. One such use is in hook-up wire in the interconnection of electronic equipment. Military specifications require that hook-up wire passes a high voltage spark test, i.e. 2500 volts RMS for 6 mil thick insulation. PTFE hook-up wire satisfies these specifications. Also, PTFE has excellent dielectric properties including a low dielectric constant and low dissipation factor. PTFE insulation is used in applications where use temperature may be as high as 260° C. or as low as near −273° C. PTFE insulation is essentially chemically inert and therefore may be used in harsh chemical environments.

The disadvantages of this material, however, is that it has poor mechanical properties such as low cut-through resistance, low cold flow resistance, and low tensile strength. Typically, PTFE insulated wires have significantly lower cut-through resistance than such insulating materials as polyimide and polyester films and an extruded copolymer of ethylene and tetrafluoroethylene sold under the DuPont trademark, TEFZEL®. Cut-through resistance is the amount of force needed for a sharp edge to penetrate through the insulation wall and make contact with the conductor.

In 1970, a new form of PTFE was introduced (see U.S. Pat. No. 4,187,390). This high strength, expanded PTFE is an important insulation material used in the wire and cable industry. U.S. Pat. No. 3,953,566 teaches a method of making this material by expanding a paste-forming unsintered PTFE extrudate at high rates to produce strong porous materials. It has been found that these new materials in the unsintered form exhibit two crystalline melt points: one at approximately 342° C. and another at approximately 384° C.

Porous, expanded PTFE insulated wire and cable cannot be used as a hook-up wire because it does not have the desired electrical property of high voltage breakdown as required by the military specification. When multiple layers of this insulation are wrapped around a conductor, there can be poor adhesion between the multiple layers of insulation when it is sintered. This insulation also absorbs low surface tension liquids (e.g. less than 50 dynes/cm). As a result, the insulation cannot be used as the sole insulation in many applications.

Porous, expanded PTFE insulation, however, is highly desirable because of its excellent dielectric properties such as very low dielectric constant and very low dissipation factor.

The present invention provides an insulation that has the desired electrical property of high voltage breakdown as well as the desired mechanical property of increased cut-through resistance and the desired electrical properties, e.g. low dielectric constant and low dissipation factor.

SUMMARY OF THE INVENTION

A method for increasing the cut-through resistance of a PTFE insulated conductor is provided comprising the steps of insulating the conductor with at least one layer of an expanded PTFE insulation that has been compressed and thereby densified and then heating the insulated conductor to a temperature above 345° C. for a period of time. The insulation material after compression has a density of greater than 1.9 g/cm$^3$ and prior to heating above 345° C. has two crystalline melt points—one at about 342° C. and another at a temperature above 375° C. The insulation after heating above 345° C. may have crystalline melt points at about 327, at about 342, and at a temperature above 375° C., or it may only have crystalline melt points at about 327° C. and at a temperature above 375° C. depending on the time that it is exposed to the high temperatures. The method also provides first covering the conductor with at least one layer of standard PTFE prior to covering with the high strength compressed PTFE. For the purposes of this patent application, standard PTFE is defined as extruded unsintered PTFE tape that has been calendered and from which the lubricant has been removed. This material typically has a density of about 1.6 gm/cm$^3$ and a thickness in the range 0.0015–0.015 inches.

A PTFE insulated conductor is also provided having increased cut-through resistance wherein the insulation has a density of greater than 1.9 g/cc and a crystalline melt point at about 385° C. In one embodiment, the conductor is first covered with standard PTFE and then wrapped with the high strength, high cut-through resistance tape. Equally, the conductor can first be covered with a high strength, high cut-through resistance tape and then covered with standard PTFE.

BRIEF DESCRIPTION OF THE FIGURE

The FIGURE is a schematic representation of the dynamic cut-through tester.

DETAILED DESCRIPTION OF THE INVENTION

Figure 1:
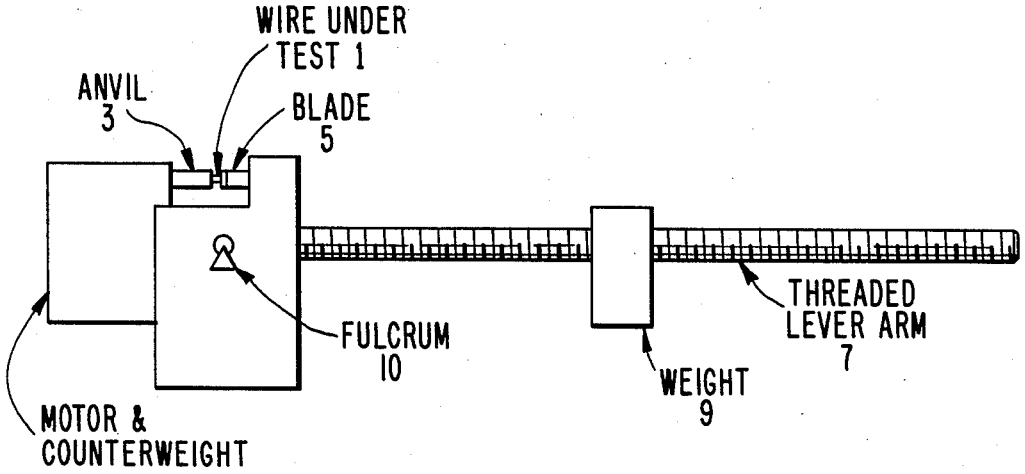

A method for increasing the cut-through resistance of a PTFE insulated conductor is provided.

As discussed above, U.S. Pat. No. 3,953,566 (herein incorporated by reference) teaches a method of expanding unsintered PTFE extrudate by stretching at high rates to produce strong materials.

The method of making the present invention is now described. A PTFE extrudate is expanded as described in the U.S. Pat. No. 3,953,566. This expanded material is then compressed to a density of greater than 1.9 gm/cc by passing it through the nip of a set of compression rolls. This removes the porosity and increases the density of film. This film, however, retains its high strength.

The compressed, expanded material can be applied directly to a bare conductor or it can be applied over a conductor that has previously been wrapped with one or more layers of standard PTFE tape. The expanded, compressed material can optionally contain a filler. Also, the compressed, expanded material can be applied to the conductor in any number of layers and it can also be alternated with layers of standard tape.

This high strength, compressed film that has been wrapped around the bare conductor or other layers of standard PTFE or expanded, porous PTFE is subsequently heated above its crystalline melting point of about 345° C. for a period of time. The exact temperatures and time will vary depending on the conductor size, thickness of insulation, and number of layers of insulation.

The resulting insulated cable has an increased cut-through resistance value that is more than twenty-five percent greater than that of standard PTFE insulation. To compute cut-through resistance, a 12-inch long sample is placed in a "Dynamic Cut-Through Testing Machine" as shown in the FIGURE. The sample wire 1 is supported and held in place by the anvil 3. A blade 5 with a 0.001±0.0005 inch radius is positioned at an angle perpendicular to the axis of the sample wire 1 and against the outer surface of the insulation. The machine has a threaded lever arm 7 and weight 9 with a hole through it, having matching threads so that when the threaded lever arm is rotated, the weight moves traversely along the lever arm away from the fulcrum 10. As the weight moves, the force on the blade 5 is increased. The speed of rotation of the threaded lever arm is constant such that the force of the blade is increased at a rate of 10 kg/minute. An electrical detection circuit senses when the blade has pierced the insulation and touches the conductor and stops the rotation of the threaded lever arm. This is considered the end of the test. A timer measures the amount of time which has elapsed between the start and end of the test. This time measurement along with the known fixed rate at which the force increases allows the calculation of the force on the blade at failure. This is the dynamic cut-through resistance measurement. Ten dynamic cut-through resistance measurements are made on each sample and the results are averaged.

Test results are highly dependent on the local sharpness of the blade. This puts strict requirements on the blade hardness and uniformity across the entire cutting surface. Care must be taken to use only blades that are uniformly sharp and durable. The blade should be calibrated before each test.

One method to check the calibration of the blade is to test an AWG 30 solid wire insulated with a 0.00475 inch thickness of TEFZEL® insulation. When the failure occurs at 1.0 kilograms plus or minus 0.1 kilograms, the blade is at the desired sharpness.

The following examples which disclose processes and products according to the present invention are illustrative only and are not intended to limit the scope of the present invention in any way.

EXAMPLE I

PTFE resin was blended with lubricant and paste extruded to result in a wet extrudate. This wet extrudate was then rolled by calender rolls to produce a film 0.016 inch thick and about 6 inches wide. This extrudate was then dried by passing it around heated drums at a temperature of approximately 250° C. and subsequently expanded 2:1 at a temperature of 275° C. by stretching it between two differential speed rolls; the output speed of the second (fast) roll being 105 ft/min. The resulting tape had a thickness of about 0.015 inches, a width of about 4.9 inches, and a density of about 0.97 g/cm$^3$.

The dry, unsintered PTFE tape was further processed on a multi-roll 3-stage plate expander. In the first stage the input speed roll was set at 1.85 ft/min., and the output speed roll was set at 37.5 ft/min (20:1). The distance between these rolls was 2 feet. The temperature of this expansion plate was 325° C. The output speed roll from the second stage, which sequentially followed the first, was 75 ft/min. (2:1). The distance was again 2 feet between rolls. The temperature of the second expansion plate was 325° C. The third stage sequentially followed the second. The speed of the output roll from the third stage was 75 ft/min. The temperature was 330° C. The distance between rolls was 4 feet.

Thus, the expansion ratio on the plate machine was 40:1 and the total expansion ratio was 80:1. The properties of this expanded tape were as follows: thickness of about 0.002 inches, width of about 1.7 inches, and density of about 0.56 g/cc. A Differential Scanning Calorimetry (D.S.C.) test showed two crystalline melt points, one at about 344° C. and a second at about 379° C.

The expanded tape was then compressed between two polished steel rolls, heated to a temperature of about 90° C., so that the final density of the tape was about 1.96 g/cc. The final thickness was about 0.0006 inches and the final width was about 1.7 inches. A D.S.C. test showed two crystalline melt points, one at about 345° C. and another at about 383° C.

This compressed, expanded PTFE tape was then slit and helically wrapped according to conventional tape wrapping techniques onto a 30(1) AWG conductor. Eleven layers were applied resulting in a final wall thickness of about 0.006 inches. These layers were applied in 3 passes of 3 layers and 1 pass of 2 layers, each successive pass was applied with opposite lay direction.

The tape wrapped conductor was then passed through a salt bath heated at a temperature of about 390° C. for a period of 5–7 seconds. A standard PTFE insulated conductor was prepared as follows: 3 layers of an unsintered PTFE tape with a thickness of 0.003" and a density of about 1.54 gm/cm$^3$ were tape wrapped on a 30(1) AWG conductor in one pass. The insulated conductor was then heated at about 390° C. in a salt bath for a period of 5–7 seconds.

A series of cut-through resistance tests were performed on both products using the "Dynamic Cut-Through Testing Machine." Ten samples were tested and averaged. The results for each are shown below in Table I. A comparative sample of a 30-gauge conductor insulated with TEFZEL insulation with a 5 mil wall was also tested.

Similar procedures were applied to a 38(1) AWG conductor and a 18(1) conductor. These results are also found in Table I.

TABLE I

| Conductor | High Strength Compressed PTFE | | Standard PTFE | | TEFZEL ® Insulation (Blade Calibration) | |
|---|---|---|---|---|---|---|
| | Final O. D. | Cut-Through Resistance | Final O. D. | Cut-Through Resistance | Final O. D. | Cut-Through Resistance |
| 30(1) | 0.023" | 1.40 kgs. | 0.024" | 0.85 kgs. | 0.020" | 1.08 kgs. |
| 38(1) | 0.018" | 2.08 kgs. | 0.018" | 0.99 kgs. | | 1.01 kgs. |
| 18(1) | 0.053" | 3.21 kgs. | 0.053" | 1.57 kgs. | | 1.01 kgs. |

EXAMPLE II

A 24(7/32) conductor was wrapped with 2 layers of 0.002" standard PTFE tape having a density of 1.55 gm/cm$^3$. It was then wrapped with 6 layers of the 0.00059" high strength compressed tape made as described in Example I, in 3 passes, 2 layers in each pass, and each successive pass wrapped with the opposite lay direction. The wrapped conductor was heated to 390° C. for 13 seconds. A standard PTFE insulated conductor was prepared as follows: 3 layers of 0.0025 inch standard PTFE tape was applied in one pass to a 24(7/32) conductor. The insulated conductor was heated in a salt bath at 390° C. for 13 seconds. Table II shows the values for cut-through resistance and final outer diameter for both samples.

TABLE II

| Conductor | High Strength Compressed PTFE | | Standard PTFE | |
|---|---|---|---|---|
| | Final O. D. | Cut-Through Resistance | Final O. D. | Cut-Through Resistance |
| 24(7/32) | .035" | 1.64 | .035" | 0.77 |

EXAMPLE III

A standard PTFE insulated conductor and a conductor insulated with the high strength, compressed film both made as in Example II, were prepared. In this case, both samples were heated to 370° C. for 120 seconds in a salt bath. Table III shows the cut-through resistance values of each.

TABLE III

| Conductor | High Strength Compressed PTFE | | Standard PTFE | |
|---|---|---|---|---|
| | Final O. D. | Cut-Through Resistance | Final O. D. | Cut-Through Resistance |
| 24(7/32) | .035" | 1.49 | .035" | 0.80 |

We claim:

1. A method for increasing the cut-through resistance of a PTFE insulated conductor comprising:
   (a) insulating a conductor with at least one layer of expanded PTFE tape that has been compressed to a density of greater than about 1.9 g/cm$^3$ and has a crystalline melt point above 375° C.; and
   (b) heating said insulated conductor to a temperature above 345° C.

2. The method of claim 1 in which the conductor is first covered with at least one layer of standard PTFE tape.

3. The method of claim 1 in which the insulated conductor is subsequently covered with at least one layer of standard PTFE tape prior to the heating step.

4. The method of claim 1 in which the conductor is first covered with at least one layer of expanded PTFE tape.

5. The method of claim 1 in which the insulated conductor is subsequently covered with at least one layer of expanded PTFE tape prior to the heating step.

6. The method of claim 1 in which the PTFE contains a filler.

* * * * *